United States Patent [19]

Lamot

[11] Patent Number: 4,639,951

[45] Date of Patent: Feb. 3, 1987

[54] WEAR PLATE FOR FLUSH VALVE ASSEMBLY

[76] Inventor: Jerzy Lamot, 232 N. George Mason, #1, Arlington, Va. 22203

[21] Appl. No.: 832,657

[22] Filed: Feb. 25, 1986

[51] Int. Cl.[4] ..... E03D 1/35

[52] U.S. Cl. ..... 4/392; 4/393

[58] Field of Search ..... 4/382, 393, 392, 379, 4/661

[56] References Cited

U.S. PATENT DOCUMENTS 2,773,268 12/1956 Hurko et al. ..... 4/393
4,004,601 1/1977 Bachelder et al. .
4,134,165 1/1979 Phripp et al. ..... 4/393
4,491,990 1/1985 Robinson et al. .
4,502,851 3/1985 Calvin et al. .

*Primary Examiner*—James E. Bryant, III
*Assistant Examiner*—L. J. Peters
*Attorney, Agent, or Firm*—Renee S. Rutkowski; Warren N. Low

[57] ABSTRACT

A reliable, inexpensive wear plate attachment for conventional toilet flush valve assemblies which is easily attached to the same for repair of a broken or worn pivoted valve stop wall portion, or, for attachment prior to breakdown in a program of preventative maintenance, thereby obviating expensive and more complex replacement of a major portion of the valve assembly.

6 Claims, 5 Drawing Figures

WEAR PLATE FOR FLUSH VALVE ASSEMBLY

BACKGROUND OF THE INVENTION

With the development of modern materials, such as readily molded plastics, there have been available on the market for many years flush valve assemblies for the tanks of water closets which include a number of parts molded from plastics thereby achieving economies of manufacture as well as the ability to fabricate complex shapes without requiring the mechanical interfitment of a plurality of individual discrete parts with entailed labor costs and potential for slight misassembly and resulting leakage from the tank.

Such valve assemblies commonly used in flush closets usually include a valve seat assembly for mechanical securement to the out flow aperture at the bottom of the tank, and a valve assembly mounted thereon for pivotal motion between valve closed position and thence through an acurate path to a valve open position, with the valve assembly pivoted to elevate the valve to its uppermost position in response to actuation of a flush lever or other conventional means.

Such devices are well known in the art and a great number of the same, as noted, have received wide commercial and public acceptance, and indeed are manufactured and installed in the many thousands of units.

Illustrative teachings of such devices and which also are found in the marketplace include the Flush Valve shown in U.S. Pat. No. 2,773,268 to Hurko et al or the Flush Toilet Accessory shown in U.S. Pat. No. 4,134,165 to Phripp et al, or other patents as U.S. Pat. No. 3,988,785, to Schoepe et al. for example.

Accordingly, while the utilization of modern plastic materials has facilitated the ready fabrication and availability of complete valve assemblies at overall low cost, a disadvantage associated with such constructions is that fracture of any one small area thereof may require replacement of the entire assembly, rather than just repair of a small portion thereof or its simple and effective replacement.

Specifically, in connection with pivoted lifting flush valves of this type, it is normal practice to provide stop means to limit the upward swinging and opening movement of the valve. Such stop means are readily provided by the engaging abutment of a stop extension on the valve arm with a stop surface as an intercepting wall on the fixed support for the pivoted valve arm. As in the course of use, the valve is opened a great number of times in ordinary flushing operations, the valve arm stop extension makes repeated contact and impact against its stop surface on the arm support.

This has not infrequently led to fracture of the stop surface on the support, whereupon the actuation of the valve at that time, or on its succeeding actuation, will cause the same to swing through its pivot path to an excessive degree and to an overcenter position, whereby the valve will not readily close in ordinary manner, or indeed, is unable to close at all.

Upon such occurrence, the householder has the immediate problem of attending to the continuous and unintended water flow through the tank as well as the necessity of obtaining attention to the mechanical valve problem.

As indicated, the result of the fracture of even a small area in the complexly molded plastic unit normally requires replacement of the entire valve assembly or a major portion thereof at substantial cost and inconvenience to the householder or to the owner and operator of facilities having plural or a multiplicity of flush closets, as apartments, office buildings, etc. Further, it will be evident that the cost and waste of water alone renders such valve inoperable absolutely intolerable. Illustratively, in a single home toilet, for example, the water loss in just one day's time would be on the order of 7,200 gallons.

BRIEF SUMMARY OF THE INVENTION

The instant invention effects a simple yet highly effective improvement which is readily and easily adaptable to flush closet valve assemblies of the type discussed and which are in widespread use in the United States and elsewhere.

To this end, the invention comprises a particularly configured wear plate to be associated with the valve assembly which will in the instance of preventative installation preclude unwanted breakdown or fracture of the support wall portion normally regularly engaged by the valve stop extension, and further and equally importantly, can be readily provided and installed to repair in reliable manner a fractured valve assembly without requiring replacement of the entire construction or a major component thereof.

The wear plate of the present invention is effectively constructed of a single piece of material, preferrably metal, illustratively galvanized steel, and which may reside immersed in the flush closet tank in mechanical association with the valve component for an indefinite period. As a metal wear plate insert, the same may repeatedly be subjected to impacts of the valve arm stop extension with no likelihood of breakdown or malfunction.

Indeed, with the wear plate of the present invention, and which may be slightly modified as requisite for differing manufacturers of valve assemblies while still embracing the inventive principles herein, a supply of the same may be readily available at hardware stores and equally in the inventory of large multi-unit establishments, as large apartment buildings, whereby both repair and preventative maintenance may be applied whenever desired to the existing valve assemblies and thereby sharply reduce costs and necessary service calls with respect thereto.

BRIEF DESCRIPTION OF THE DRAWINGS

The invention will be better understood taken in connection with the accompanying drawings in which.

DESCRIPTION OF THE PREFERRED EMBODIMENT

Figure 1:
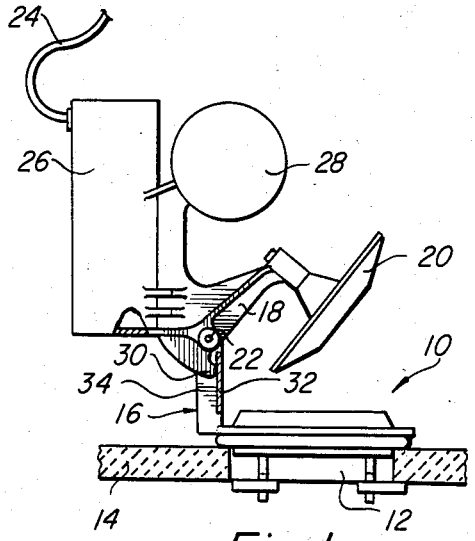
Fig. 1 (PRIOR ART)
FIG. 1 is a side elevation, partly in section, of one well known prior art valve assembly of the type contemplated.
Figure 2:
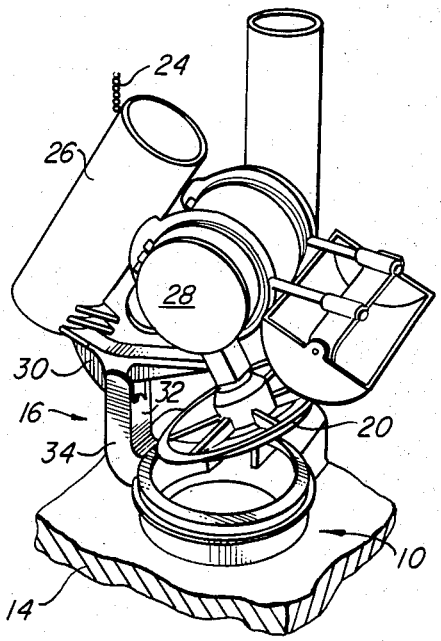
Fig. 2 (PRIOR ART)
FIG. 2 is a perspective view, partially in section, of another well known prior art valve assembly of the type contemplated.

Referring to the drawings, FIG. 1 and FIG. 2 are illustrative of well known flush closet valve assemblies widely used throughout the country and which are typical of similar and related forms thereof made by various manufacturers. Specifically the form of valve assembly shown in FIG. 1 comprises that shown in U.S. Pat. No. 2,773,268 to Hurko et al while that shown in FIG. 2 in like manner corresponds to that shown in U.S. Pat. No. 4,134,165 to Phripp et al.

While details of these and similar valve assemblies vary, the essential construction thereof is similar in all such devices associated with flush closets, and essentially include a valve seat assembly 10 as associated with the drain aperture 12 in the usual flush tank bottom wall 14. As seen in the FIG. 1 illustration, the seat assembly 10 may be secured therein as by clamping means such as bolts etc., all as well know in the art. The valve seat assembly 10 includes therewith an upstanding support arm 16 for reception at the top thereof a suitable pivot mounting for the valve arm 18 which carries the valve element 20 for closing the valve seat at 10. As seen in FIG. 1 as well as in the enlarged detailed view of FIG. 5, the pivot mounting associated with the vertical support 16 includes a pivot shaft or the like at 22 of conventional nature as taught in the aforesaid and other patents which defines a generally horizontal pivot axis about which valve arm 18 rotates between valve open and valve closed positions.

Valve assemblies of the type shown as in the illustrative prior art of FIG. 1 and 2 include diverse other detail elements not relevant to the instant invention but which not uncommonly include a cylindrical reservoir as at 26 as well as a float member 28, all as well known in the art. Details of these and like constructions are available in the disclosures of the aforesaid prior art patents.

Turning now more particularly to the conventional arm 18 which pivots about shaft 22, the remote end of the arm from the valve 20 on the other side of the pivot shaft includes a stop extension portion 30 which may be of varying constructions but in the illustrative embodiment of FIG. 1, for example, constitutes a rounded projection. The fixed support element 16 for the pivoted valve assembly in like manner conventionally includes a central wall portion as at 32 against which the extension stop 30 abuts and engages as the valve 20 pivots to its upwardmost position.

In the normal operation of a flush toilet, each actuation of the flushing mechanism will cause the valve 20 to be lifted up from its seat 10 and pivot until the extension stop 30 abuts the wall portion 32 of support 16.

The support 16 often forms part of the relatively intricately molded plastic valve seat assembly for simplicity of manufacture, and wherein the wall portion 32 normally lies between molded parallel upwardly extending leg portions 34, together defining a generally U-shaped cross section. The stop extension 30 of arm 18 in swinging in the counterclockwise direction as seen in FIGS. 1 and 2 enters between the parallel legs 34 until the extension 30 abuts the wall portion 32 as aforesaid.

Figure 3:
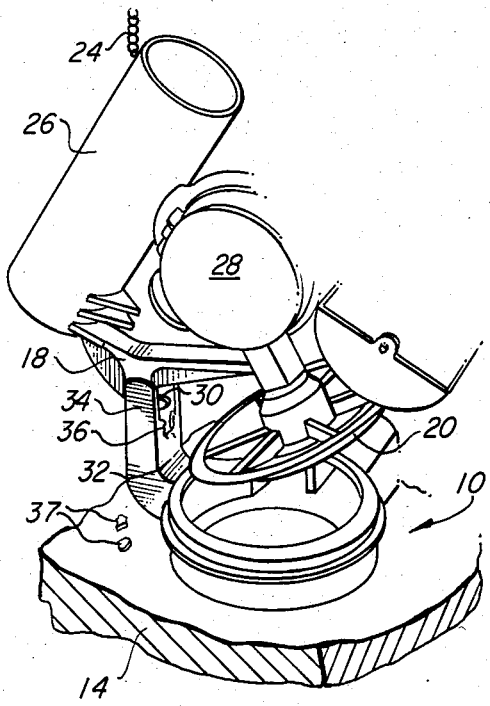
Fig. 3 (PRIOR ART)
FIG. 3 is similar to FIG. 2 but illustrating a fracture thereof as frequently occurs.

By virtue of the geometry of the construction, the stop extension 30 repetitively forcibly engages the web or wall portion 32 at the same locale upon each flush actuation. In the course of time it is not uncommon for the wall portion at the point of impact of extension 30 to fracture or rupture and break away. Such a fracturing is shown illustratively at 36 in FIG. 3 as applied to a valve of this type and of type shown in FIG. 2, for example. With a portion of wall 32 broken away by the repetitive impact of extension 30 as seen 36 in FIG. 3 an perhaps with further cracks in the wall portion 32 along with fallen broken fragments of plastic as at 37, the restraint to pivotal motion of valve arm 18 is removed and it is thereby possible for the valve arm to continue a swinging movement upwardly and to the left especially as under the weight of water in reservoir 26 and carry the valve 20 upwardly and rearwardly to an inoperative position from which the same will not restore routinely to closed position upon normal refilling of the tank.

When such fracture occurs, the valving assembly becomes useless and must be promptly attended to in order to avoid continuous loss of water as well as to render the flushing mechanism again workable.

As the stop wall portion 32 normally forms part of an intergral injection molded or otherwise formed support 16 and associated seat 18, it is necessary to replace the entire assembly thereat, requiring disassembly of the valve seat from the tank and the obvious additional cost of replacing the entire unit.

Figure 4:
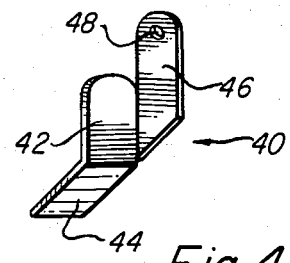
FIG. 4 is a perspective view of the wear plate of the present invention; and, FIG. 5 is a side elevation, partially fragmentary, and on an enlarged scale illustrating the wear plate of the present invention installed with a pre-existing support in a valve assembly.
Figure 5:
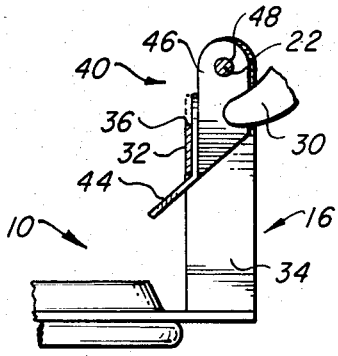

In the present invention, however, expeditious means in the form of a novel and unique wear plate generally designated 40 as seen in FIGS. 4 and 5 is provided to obviate the difficulties and expense associated with the cracking and fracturing of wall 32 as seen at 36.

The improved wear plate 40 is inexpensively and reliably formed from sheet metal, illustratively galvanized steel and consists essentially of an L-shaped member including a generally planar abutment wear plate portion 42 from which an obliquely angled leg 44 depends. Associated with one lateral edge of the wear plate portion 42 is a right-angularly disposed upstanding ear 46 which is apertured at 48 thereby to receive therethrough the pivot shaft 22.

By virture of the simple one-piece fabrication thereof, it will be evident that the wear plate 40 may be produced in large quantities at very little cost, and yet serves to restore the valve assembly to full and reliable operational condition without requiring throwaway of any portion thereof.

The association of the improved wear plate 40 with the support arm 16 of any of the illustrative valve assemblies is evident from FIG. 5. As seen therein, the wear plate wall portion 42 of the element 40 lies in planar overlying contacting relation to the wall 32 of the support 16 and is of a length so as to extend above the broken off, weakened, or fractured portion 36 of the front wall 32. The ear 46 of the wear plate 40 is disposed at right angles to the wear plate portion 42, and the polymeric elements of the pivot support 16 may be flexed sufficiently to permit the aperture 48 in the wear plate 40 to be snapped over the shaft 22 or a stub pin thereof, whereby the wear plate 40 is securely held in position on the support 16 to dispose the contact wall 42 thereof properly with respect to the extension stop 30 of arm 18.

While the element 40 to some extent may be free to swing slightly about the pivot axis, with respect to the support, in use, whenever the valve 20 is elevated in usual flushing operations, the approach of the valve arm stop extension 30 toward the wear plate 40 will cause the extension 30 to engage the wear plate wall 42 and bring the same firmly up against the forward wall of the support 16. As the wear plate 40 is of a durable material as metal, repeated impact of the extension 30 therewith will have no adverse effects upon the element 40.

It is not necessary to wait until the wall portion 32 of the support 16 fails in service as by cracking or fracturing into a broken zone 36 with fragments 37. Rather, on a preventative maintenance basis or schedule, especially in a large insitutional environment, but also the individual home if desired, the durable wear plate 40 may be readily installed in the support arm 16 of the existing valve assembly even though the wall portion 32 is still intact. In this case, the support wall portion 32 would have its full and normal length as shown in dashed lines in FIG. 5 rather than be broken away as in FIG. 3.

While I have shown the wear plate 40 as having single ear 46 for simplicity and ease of fabrication, obviously the same may have a pair of ears on opposite sides thereof if necessary or desirable in a particular installation.

Inasmuch as the sole function of the ear 46 is to provide a support means to properly locate the wear plate with respect to the arm stop 30, the single ear 46 is normally adequate as well as reducing the cost of constructions.

While a great many valve assemblies of the type discussed include the basic molded U-shaped plastic post as at 16 with which the wear plate 40 is suitably associated, it is obvious that like simple wear plates may have particular dimensions to accommodate particular models of valve assemblies within the spirit and scope of the invention herein.

Also, while I have shown the wear plate 40 as having an oblique leg 44 to facilitate its use with one form of commercially available flush valve, it will be apparent that for differing valve structures the leg may extend directly downwardly and form an extended part of surface 42, among other configuartory variations.

I have shown and described a perferred embodiment of my invention. My invention is, however, susceptible to adaptation to specific and different forms within the scope thereof, as defined by the claims.

I claim:

1. In a tank outflow valve for a flush closet, with said valve mounted on an arm for pivotal swinging movement, about a horizontal axis through a path between a lower valve-closed position and an upper valve-open position wherein the valve mounting includes pivot shaft at said axis for said arm, said arm having a stop extension thereon, and a rigid support for said pivot shaft means, said support including a wall portion thereof interposed in the path of said arm stop extension, thereby to be engaged by said extension during valve-opening arm swinging movement, the improvement therein comprising an auxiliary wear plate having means for mounting said wear plate in proximate relation to said support wall portion and wherein the wear plate is in intercepting relation to said valve arm stop extension, thereby to preclude engagement of said extension with said wall portion.

2. The improved wear plate for a flush closet valve of claim 1 wherein said means for mounting said wear plate includes a ear thereon for connection on said support in surrounding relation to said axis.

3. The improved wear plate for a flush closet valve of claim 1 wherein said wear plate is formed of rigid material.

4. The improved wear plate for a flush closet valve of claim 3 wherein said material is metal.

5. The improved wear plate for a flush closet valve of claim 4 wherein said metal is galvanized steel or stainless steel.

6. The improved wear plate for a flush closet valve of claim 1 wherein said wear plate includes a substantially planar stop-intercepting poriton, and an ear extending therefrom defining a pivot axis-receiving aperture to dispose said axis substantially parallel to said stop-intercepting portion.

* * * * *